US011530903B2

(12) United States Patent
Burke et al.

(10) Patent No.: US 11,530,903 B2
(45) Date of Patent: Dec. 20, 2022

(54) SHORT-RANGE CONDUCTED ELECTRICAL WEAPON

(71) Applicant: Axon Enterprise, Inc., Scottsdale, AZ (US)

(72) Inventors: Liam Quinn Burke, Scottsdale, AZ (US); Anne Peabody Pratt, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 16/814,219

(22) Filed: Mar. 10, 2020

(65) Prior Publication Data

US 2020/0300585 A1 Sep. 24, 2020

Related U.S. Application Data

(60) Provisional application No. 62/820,073, filed on Mar. 18, 2019.

(51) Int. Cl.
*F41H 13/00* (2006.01)
*A41D 1/00* (2018.01)

(52) U.S. Cl.
CPC ..... *F41H 13/0025* (2013.01); *A41D 1/005* (2013.01)

(58) Field of Classification Search
CPC ..... F41H 13/0025; A41D 1/005
USPC ..... 361/232
See application file for complete search history.

(56) References Cited

U.S. PATENT DOCUMENTS

| | | | | |
|---|---|---|---|---|
| 4,162,515 | A * | 7/1979 | Henderson | F41H 13/0018 231/7 |
| 7,444,940 | B2 | 11/2008 | Kapeles et al. | |
| 7,905,180 | B2 * | 3/2011 | Chen | F41H 13/0025 361/232 |
| 9,267,768 | B1 * | 2/2016 | Chang | F41H 13/0025 |
| 9,518,727 | B1 * | 12/2016 | Markle | F21V 17/002 |
| 9,599,440 | B1 | 3/2017 | Gish et al. | |
| 2018/0259303 | A1 * | 9/2018 | Nerheim | F41H 13/0025 |
| 2020/0109933 | A1 * | 4/2020 | Brundula | F42C 19/12 |

* cited by examiner

*Primary Examiner* — Scott Bauer
*Assistant Examiner* — Sreeya Sreevatsa
(74) *Attorney, Agent, or Firm* — Justin Powley

(57) ABSTRACT

A short-range conducted electrical weapon ("conducted electrical weapon") may be configured to deploy electrodes having a minimum spacing when coupled to a target at short-range. The conducted electrical weapon may comprise a housing. The housing may comprise a target end opposite a grip end. The grip end may be configured to removably receive a cartridge. The cartridge may house two or more electrodes. The target end may comprise one or more activation buttons or terminals. In response to the activation buttons or terminals being activated, the electrodes may be launched from the cartridge in the grip end. The electrodes may be disposed in the cartridge at an obtuse angle relative to the placement of the opposite electrode. The obtuse angle may enable the electrodes to be deployed effectively at short range.

20 Claims, 10 Drawing Sheets

SHORT-RANGE CONDUCTED ELECTRICAL WEAPON

CROSS REFERENCE TO RELATED APPLICATIONS

This application is a nonprovisional of, and claims priority to and the benefit of, U.S. Provisional Patent Application No. 62/820,073, filed Mar. 18, 2019 and entitled "SHORT-RANGE CONDUCTED ELECTRICAL WEAPON," which is hereby incorporated by reference in its entirety.

FIELD

The present disclosure relates to a conducted electrical weapon ("CEW").

BACKGROUND

CEWs provide and deliver an electrical current through tissue of a human or animal target. The current may interfere with the voluntary locomotion, for example, walking, running, moving, etc., of the target. The current may cause pain or other discomfort that encourages the target to stop voluntary locomotion. The current may cause neuromuscular incapacitation by causing skeletal muscles of the target to become stiff, lock up, and/or freeze so as to disrupt voluntary control of the muscles. This incapacitation interferes with voluntary locomotion by the target. Typical CEW's launch two or more electrodes to remotely deliver the current through tissue of the target. The electrodes may electrically couple to the target to enable the CEW to deliver the current through the electrodes to the target. The current may be more effective when a minimum spacing exists between the coupled electrodes. In situations where the CEW is deployed at short range, the minimum spacing may be difficult to obtain using a typical CEW.

SUMMARY

In various embodiments, a conducted electrical weapon is disclosed. The conducting electrical weapon may comprise a housing having a target end and a grip end, wherein the target end is disposed opposite the grip end. The conducted electrical weapon may comprise a plurality of electrodes disposed in the grip end, wherein the electrodes are configured to deploy in a direction towards the target end in response to an activation on the target end.

In various embodiments, a first electrode of the plurality of electrodes may be disposed along a first deployment axis, a second electrode of the plurality of electrodes may be disposed along a second deployment axis, the first deployment axis and the second deployment axis may define a deployment angle, and the deployment angle may be greater than 90° and less than 180°. The conducted electrical weapon may also comprise a first activation terminal coupled to the target end; and a second activation terminal coupled to the target end, wherein the plurality of electrodes are configured to deploy in response to the first activation terminal and/or the second activation terminal being at least partially depressed, and wherein the first activation terminal and the second activation terminal are configured to discharge an electrical arc between each activation terminal in response to the conducted electrical weapon receiving a warning input. The conducted electrical weapon may also comprise an activation terminal coupled to the target end, wherein in response to the activation terminal being at least partially depressed, the plurality of electrodes are configured to deploy, and wherein in response to the conducted electrical weapon receiving a warning input the activation terminal is configured to discharge an electrical arc along the target end. The conducted electrical weapon may also comprise a conductive surface coupled to the target end proximate the activation terminal, wherein the activation terminal is configured to discharge the electrical arc along the conductive surface. The conducted electrical weapon may also comprise a first electrical terminal coupled to the target end and a second electrical terminal coupled to the target end proximate the first electrical terminal, wherein in response to the conducted electrical weapon receiving a warning input the first electrical terminal and the second electrical terminal are configured to discharge an electrical arc between each electrical terminal; and an activation button coupled to the target end between the first electrical terminal and the second electrical terminal, wherein in response to the activation button being at least partially depressed, the plurality of electrodes are configured to deploy.

In various embodiments, a conducted electrical weapon may comprise a housing. The housing may comprise an outer surface opposite an inner surface; a target end opposite a grip end; and a cartridge bay located in the grip end. The conducted electrical weapon may comprise a cartridge removably coupled within the cartridge bay. The cartridge may comprise a first electrode and a second electrode. In response to the conducted electrical weapon being activated the first electrode and the second electrode may be configured to deploy in a direction towards the target end of the housing.

In various embodiments, the housing may comprise a symmetrical circular shape. The conducted electrical weapon may also comprise a battery coupled on the inner surface of the housing; a controller coupled on the inner surface of the housing, wherein the controller is electrically coupled to the battery; and a high-voltage module coupled on the inner surface of the housing, wherein the high-voltage module is electrically coupled to the battery, wherein the controller is configured to control electrical output from the high-voltage module, and wherein the high-voltage module is electrically coupled to the cartridge. The conducted electrical weapon may also comprise an activation terminal coupled to the target end of the housing, wherein the activation terminal is in electronic communication with a controller, and wherein in response to the activation terminal being at least partially depressed the controller is configured to enable an electrical current to pass from the high-voltage module to the cartridge to activate deployment of the first electrode and the second electrode. The conducted electrical weapon may also comprise a warning trigger coupled to the outer surface of the housing proximate the cartridge bay, wherein the warning trigger is at least one of mechanically or electronically coupled to the controller, wherein in response to the warning trigger being activated the controller is configured to enable a second electrical current to pass from the high-voltage module to the activation terminal to generate an electrical arc from the activation terminal. The conducted electrical weapon may also comprise a second cartridge removably coupled within the cartridge bay proximate the cartridge. The second cartridge may comprise a third electrode and a fourth electrode. In response to a second activation the third electrode and the fourth electrode may be configured to deploy in a direction towards the target end of the housing.

In various embodiments, a conducted electrical weapon cartridge may comprise an activation system; a first electrode disposed along a first deployment axis, wherein the first electrode is configured to be deployed by the activation system; and a second electrode disposed along a second deployment axis, wherein the second electrode is configured to be deployed by the activation system, wherein the first deployment axis and the second deployment axis define a deployment angle, and wherein the deployment angle is greater than 90° and less than 180°.

In various embodiments, the activation system of the conducted electrical weapon cartridge may comprise a primer; an activation wedge configured to be activated by the primer; a first propellant capsule proximate a first side of the activation wedge; and a second propellant capsule proximate a second side of the activation wedge, wherein in response to the activation wedge being activated the activation wedge is configured to contact the first propellant capsule and the second propellant capsule to cause the first propellant capsule to release a first propellant and the second propellant capsule to release a second propellant. The first propellant capsule may be proximate the first electrode and may deploy the first electrode, and the second propellant capsule may be proximate the second electrode and may deploy the second electrode. The activation system may also comprise a first activation pin proximate the first propellant capsule opposite the activation wedge, wherein in response to the activation wedge contacting the first propellant capsule the first activation pin punctures the first propellant capsule to release the first propellant; and a second activation pin proximate the second propellant capsule opposite the activation wedge, wherein in response to the activation wedge contacting the second propellant capsule the second activation pin punctures the second propellant capsule to release the second propellant. The conducted electrical weapon cartridge may also comprise an outer surface enclosing the activation system, the first electrode, and the second electrode; a first electrode blast door located on the outer surface proximate the first electrode, wherein the first electrode blast door is configured to allow the first electrode to deploy out the outer surface; and a second electrode blast door located on the outer surface proximate the second electrode, wherein the second electrode blast door is configured to allow the second electrode to deploy out the outer surface. The conducted electrical weapon cartridge may also comprise a first safety guard extending from the outer surface proximate the first electrode blast door; and a second safety guard extending from the outer surface proximate the second electrode blast door, wherein the first safety guard and the second safety guard are configured to at least partially prevent human blockage of the first electrode blast door and the second electrode blast door. The conducted electrical weapon cartridge may also comprise a trigger safety in electrical communication with circuitry of at least one of the primer, the first electrode, or the second electrode. The trigger safety may comprise a biometric reader.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option.

Additionally, any reference to without contact (or similar phrases) may also include reduced contact or minimal contact. Surface shading lines may be used throughout the figures to denote different parts but not necessarily to denote the same or different materials.

Figure 1A:
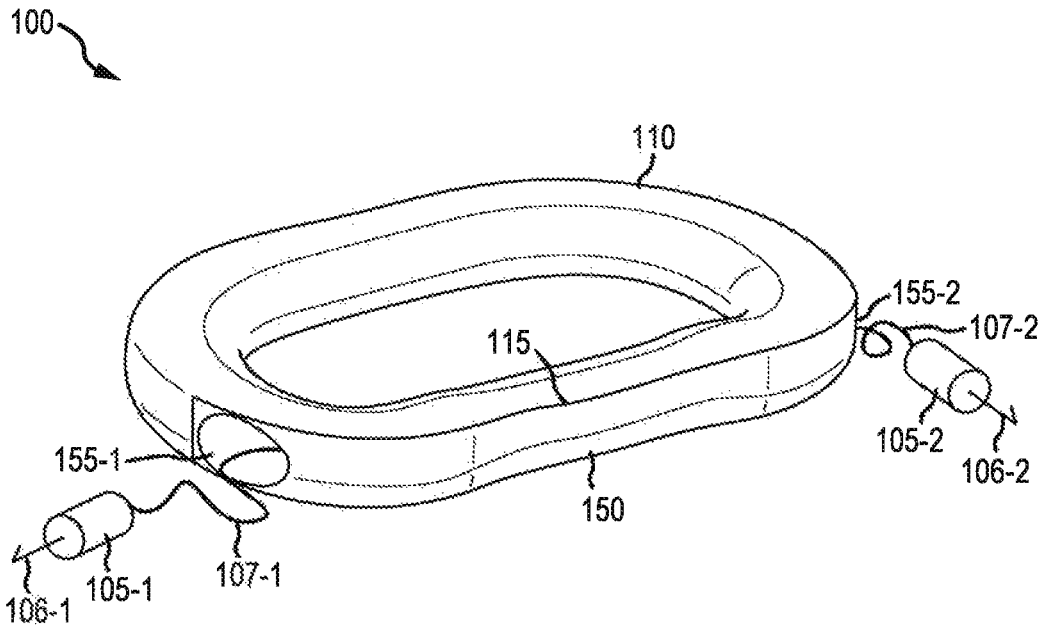
FIG. 1A illustrates a perspective view of a conducted electrical weapon ("CEW"), in accordance with various embodiments.

In various embodiments, and with reference to FIG. 1A, a short-range conducted electrical weapon (CEW) 100 is disclosed. CEW 100 may be configured to launch two or more electrodes at a short-range target. CEW 100 may launch the electrodes to ensure that a minimum spacing between the electrodes is maintained when coupled to the target. The minimum spacing may be at least twelve inches (30.48 cm), may be less than twelve inches (30.48 cm), or may be greater than twelve inches (30.48 cm). For use in close range situations, the minimum spacing of electrodes once they have exited the CEW and coupled to a target is preferably between eight and 16 inches. More preferably, the minimum spacing of electrodes once they have exited the CEW and coupled to a target is preferably between ten and fourteen inches. The minimum spacing may refer to an effective minimum distance between electrodes coupled to the target to enable the electrical current to pass between the electrodes and interfere with voluntary locomotion (e.g., walking, running, moving, etc.) of the target. As discussed further herein, the electrodes may be offset from a front end (e.g., a typical deployment end) of CEW 100 to enable the electrodes to be launched at a wider angle compared to a typical CEW. For example, the electrodes may be located in the grip end of CEW 100.

CEW 100 may comprise any suitable shape, such as, for example, a circular shape, an oval shape, a rectangular shape, or the like. CEW 100 may also comprise a C-shape (e.g., a half oval shape). CEW 100 may be symmetrical such that a user may hold CEW 100 in a variety of operating positions (e.g., in contrast to typical CEWs shaped like conventional firearms). For example, a user may hold CEW 100 such that first electrode 105-1 is deployed from a left side of the user's operating hand and second electrode 105-2 is deployed from a right side of the user's operating hand. The user may also hold CEW 100 such that the second electrode 105-2 is deployed from the left side of the user's operating hand and first electrode 105-1 is deployed from the right side of the user's operating hand. In various embodiments, a symmetrical circular shape may be beneficial in short-range operating conditions wherein a user may need to quickly grab and activate the CEW 100 (e.g., in response to the user being attacked in close-quarters, by surprise, etc.).

Electrodes 105 may be located in any suitable location in CEW 100. For example, electrodes 105 may be positioned in, or proximate to, a grip end of CEW 100 (e.g., grip end 213, as discussed further with reference to FIGS. 2A-2C). As a further example, electrodes 105 may be positioned in, or proximate to, a target end of CEW 100 (e.g., target end 214, as discussed further with reference to FIGS. 2A-2C). As a further example, electrodes 105 may be positioned in the sides of CEW 100, between the grip end and the target end of CEW 100.

CEW 100 may comprise a housing 110 and a cartridge 150. Housing 110 may comprise a cartridge bay 115 sized and shaped to receive and retain cartridge 150. Cartridge 150 may be removably coupled to housing 110 via cartridge bay 115. For example, cartridge 150 may releasably electrically and/or mechanically couple to housing 110 by being inserted into cartridge bay 115. Cartridge 150 may be configured to deploy one or more electrodes 105 (e.g., electrode darts), such as, for example, a first electrode 105-1 and a second electrode 105-2. Cartridge 150 may be removable and replaceable to facilitate repeated use of CEW 100 after discharge of electrodes 105 in a first cartridge. Cartridge 150 may comprise one or more electrode blast doors 155 configured to cover electrodes 105 and enable each electrode 105 to be deployed from cartridge 150. For example, a first electrode blast door 155-1 may be configured to enable first electrode 105-1 to be deployed and a second electrode blast door 155-2 may be configured to enable second electrode 105-2 to be deployed. Electrode blast doors 155 may be sized and shaped to enable passage of electrodes 105 from cartridge 150. Electrode blast doors 155 may be included with cartridge 150 or may be fixedly attached to housing 110. Electrode blast doors 155 may be configured to open in a hinge fashion to allow electrodes 105 to pass. Electrode blast doors 155 may completely release from cartridge 150 and housing 110 as electrodes 105 pass therethrough.

As discussed further herein, housing 110 may provide an electrical current to each electrode 105 in cartridge 150 to enable the deployment of one or more electrodes 105. For example, each electrode 105 may comprise an electrode filament 107 to electrically couple electrode 105 to cartridge 150. For example, first electrode 105-1 may comprise a first electrode filament 107-1, second electrode 105-2 may comprise a second electrode filament 107-2, etc. In that respect, each electrode filament 107 may receive the current from housing 110 and deliver the current to the respective electrode 105. Each electrode filament 107 may be spooled within electrode 105 and deployed in response to the electrode 105 being launched. Each electrode filament 107 may also be spooled or disposed within cartridge 150 proximate the disposed electrode 105. Electrode filament 107 may comprise any suitable length. For example, it may be advantageous to have a length such that a user may drop CEW 100 after launching the electrodes 105 without decoupling the electrodes from the target. Each electrode 105 may be launched toward a target to remotely deliver the current through the target. Each electrode 105 may comprise an electrode attachment 106, for example, an electrode spear, configured to engage the target to enable the electrode 105 to deliver the current. For example, first electrode 105-1 may comprise a first electrode attachment 106-1 and second electrode 105-2 may comprise a second electrode attachment 106-2, etc. Electrode attachment 106 may comprise a hook, bent end, or the like configured to aid in attaching electrode 105 to the target (e.g., to an article of clothing proximate the skin of the target).

In various embodiments, electrode attachment 106 may comprise a barbed hook or protrusion configured to aid in attaching electrodes 105 to the target at short-range. The barbed hook or protrusion may aid in anchoring electrodes 105 to a target. Releasing electrodes at close range and at a large angle relative to each other may cause the electrodes to approach a target at a low angle of incidence. At such low angles, electrode attachments 106-1 may not sufficiently anchor to a target if the electrode attachments 106-1 extend only parallel to a line of flight of the electrode 105. Therefore, electrode attachments 106-1 may extend at various angles relative to the line of flight of electrode 105. For example, electrode attachments 106-1 may include prongs positioned at an angle between one degree and eighty-nine degrees relative to the line of flight of electrode 105. Such prongs may have additional prongs extending therefrom to further aid anchoring, and multiple prongs may be included, with two or more prongs extending at different directions relative to the line of flight of electrode 105.

Each electrode 105 may typically be launched at the same time, or near the same time. Launching electrodes 105 may also be referred to herein as activating or firing CEW 100. Generally, activating CEW 100 launches all electrodes 105 from cartridge 150 such that cartridge 150 may be activated only once to launch electrodes 105. After activation, cartridge 150 may be removed from cartridge bay 115 and replaced with an unused, that is, not fired or not activated, cartridge 150 to enable additional electrode deployments.

Figure 1B:
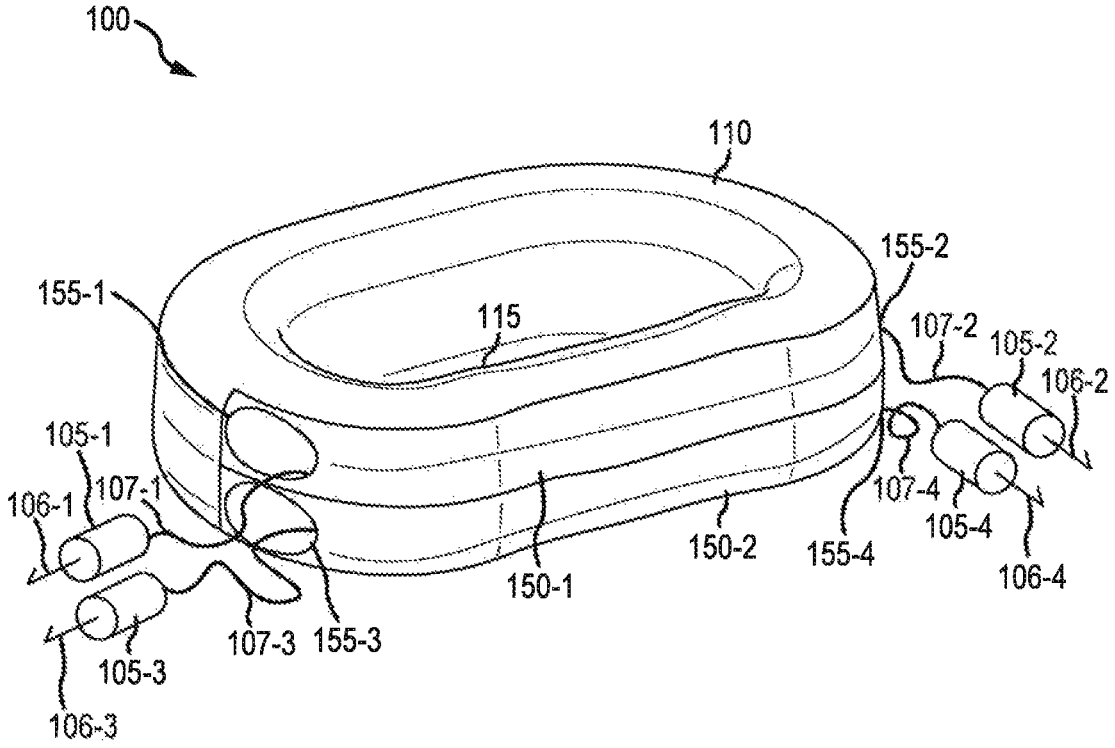
FIG. 1B illustrates a perspective view of a CEW having two cartridges, in accordance with various embodiments.

In various embodiments, cartridge bay 115 may be configured to retain any suitable or desired number of cartridges. For example, in accordance with various embodiments and with reference to FIG. 1B, cartridge bay 115 may be configured to retain a first cartridge 150-1 and a second cartridge 150-2. First cartridge 150-1 and second cartridge 150-2 may each releasably electrically and/or mechanically couple to housing 110 by being inserted into cartridge bay 115. Each cartridge 150-1, 150-2 may be configured to deploy one or more electrodes 105. For example, first cartridge 150-1 may be configured to deploy a first electrode 105-1 and a second electrode 105-2. First electrode 105-1 may comprise a first electrode filament 107-1 configured to electrically couple first electrode 105-1 to first cartridge 150-1, and a first electrode attachment 106-1. Second electrode 105-2 may comprise a second electrode filament 107-2 configured to electrically couple second electrode 105-2 to first cartridge 150-1, and a second electrode attachment 106-2. For example, second cartridge 150-2 may be configured to deploy a third electrode 105-3 and a fourth electrode 105-4. Third electrode 105-3 may comprise a third electrode filament 107-3 configured to electrically couple third electrode 105-3 to second cartridge 150-2, and a third electrode attachment 106-3. Fourth electrode 105-4 may comprise a fourth electrode filament 107-4 configured to electrically couple fourth electrode 105-4 to second cartridge 150-2, and a fourth electrode attachment 106-4.

In response to CEW 100 being activated or fired a first time, CEW 100 may launch all electrodes 105 from first cartridge 150-1 (e.g., first electrode 105-1 and second electrode 105-2). In response to CEW 100 being activated or fired a second time, CEW 100 may launch all electrodes 105 from second cartridge 150-2 (e.g., third electrode 105-3 and fourth electrode 105-4). In embodiments, a first activation of CEW 100 may deploy first electrode 105-1 and second electrode 105-2 toward a front end of CEW 100 and a second activation of CEW 100 may deploy third electrode 105-3 and fourth electrode 105-4 toward the same front end of CEW 100. In that regard, CEW 100 comprising a plurality of cartridges 150 may enable CEW 100 to be activated or fired to launch electrodes 105 multiple times before a cartridge 150 needs to be removed from cartridge bay 115 and replaced with an unused (e.g., not fired, not activated) cartridge 150 to enable additional electrode deployments. CEW 100 may also be configured to activate or fire all electrodes from both first cartridge 150-1 and second cartridge 150-2 on a single activation.

Figure 2A:
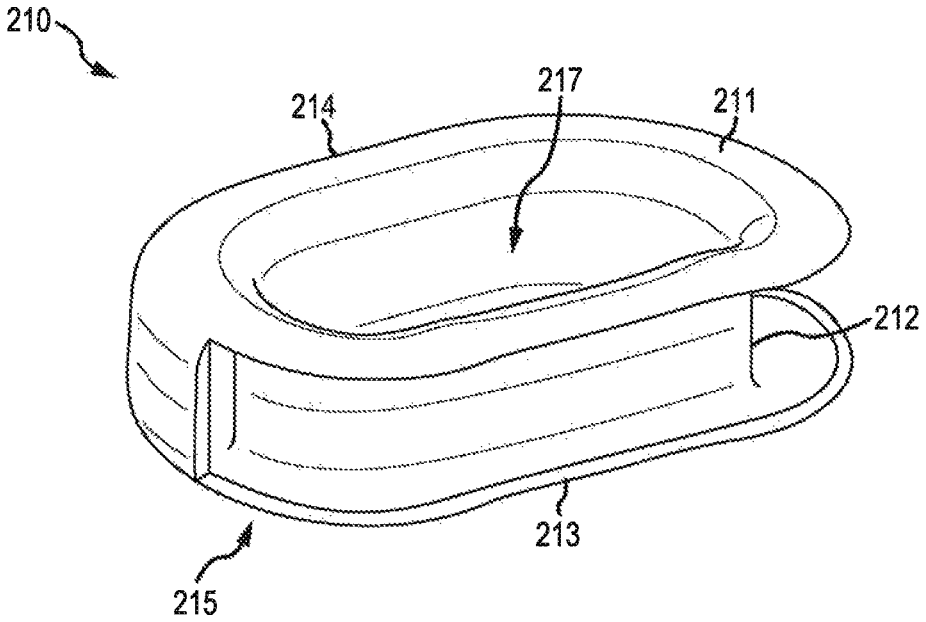
FIG. 2A illustrates a perspective view of a CEW housing, in accordance with various embodiments.
Figure 2B:
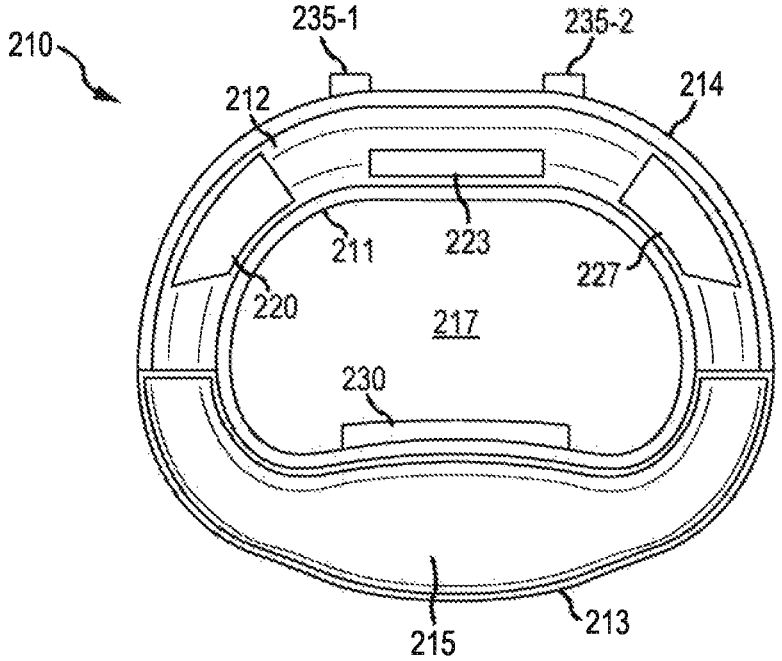
FIG. 2B illustrates a cross-sectional view of a CEW housing, in accordance with various embodiments.
Figure 2C:
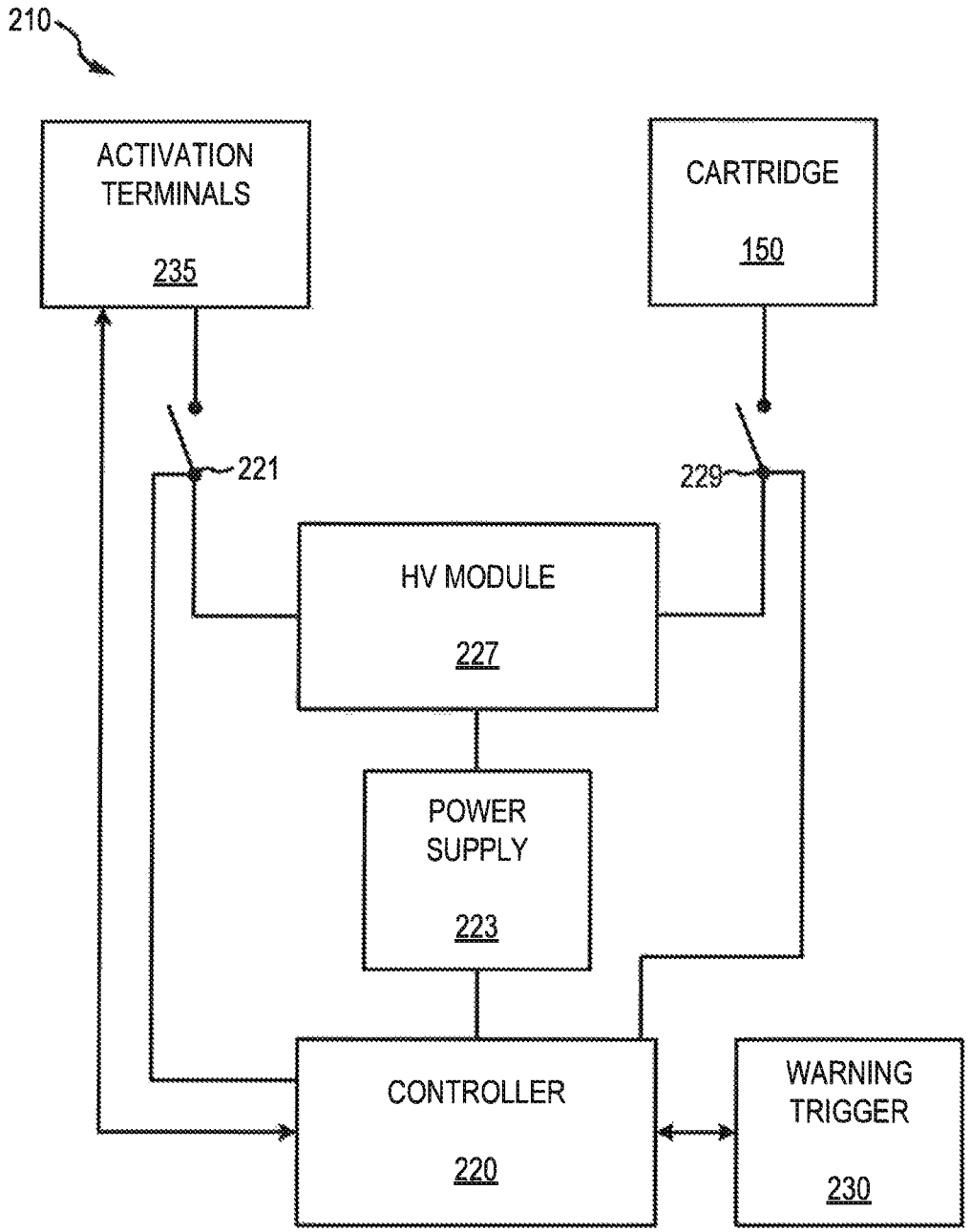
FIG. 2C illustrates a functional view of a CEW housing, in accordance with various embodiments.

In various embodiments, and with reference to FIGS. 2A-2C, an exemplary housing 210 is depicted in greater detail. Housing 210 may comprise any suitable material, such as, for example, a plastic, rubber, fiberglass, carbon fiber, such as a carbon fiber-reinforced polymer, or the like. In various embodiments, housing 210 may comprise any suitable non-conductive material. Housing 210 may vary in size and dimensions according to desired properties for different users, for example, based on hand size. Housing 210 may be formed using any suitable process, such as, for example, by a plastic molding technique, for example, rotational molding, injection molding, compression molding, blow molding, vacuum molding, etc. Housing 210 may be formed by machining, additive manufacturing, or the like. In various embodiments, housing 210 may also comprise any suitable coating, cover, or the like. For example, housing 210 may comprise a non-slip surface, grip pad, or the like. As a further example, housing 210 may be wrapped in leather, a colored print, and/or any other suitable material, as desired.

Housing 210 may comprise an outer surface 211 opposite an inner surface 212. Housing 210 may comprise a grip end 213 opposite a target end 214. Grip end 213 may be configured to enable a user to hold and operate CEW 100. Target end 214 may comprise the end of CEW 100 pointed towards a target during activation of CEW 100. Grip end 213 and target end 214 may define a handle opening 217 on outer surface 211 of housing 210. Handle opening 217 may enable the user to hold and operate CEW 100. The user may insert their fingers through handle opening 217 to hold grip end 213. In various embodiments, grip end 213 proximate handle opening 217 may comprise contours shaped to fit the hand of a user, for example, an ergonomic grip. Outer surface 211 proximate grip end 213 may define a cartridge bay 215. Cartridge bay 215 may be similar to cartridge bay 115 described herein with reference to FIGS. 1A and 1B, and may be configured to receive one or more cartridges 150.

In various embodiments, housing 210 may comprise various mechanical, electronic, and electrical components configured to aid in performing the functions of CEW 100. For example, housing 210 may comprise a controller 220, a power supply 223, a high-voltage (HV) module 227, a warning trigger 230, and/or one or more activation terminals 235. Each of the various components may be mechanically coupled to one or more of an outer surface 211 and an inner surface 212 of housing 210. Each of the various components may be directly mechanically coupled to one or more of an outer surface 211 or an inner surface 212 or indirectly mechanically coupled via one or more other components to one or more of the outer surface 211 or the inner surface 212. One or more of the various components may be at least partially disposed within the inner surface 212 of the housing 210.

Housing 210 may comprise one or more activation terminals 235, such as a first activation terminal 235-1 and a second activation terminal 235-2. Each activation terminal 235 may be coupled to outer surface 211 of target end 214. Each activation terminal 235 may be electrically coupled to HV module 227. Each activation terminal 235 may be mechanically and/or electronically coupled to controller 220.

In various embodiments, one or more of the activation terminals 235 may be configured to discharge an electrical arc. The electrical arc may be discharged between first activation terminal 235-1 and second activation terminal 235-2. For example, each activation terminal 235 may receive an electrical current from HV module 227 and may discharge the electrical current to form the electrical arc. Delivery of the electrical current via one or more activation terminals 235 may be referred to as a local delivery because CEW 100 may be brought proximate to the target to deliver the electrical current. For example, a user may bring each activation terminal 235 into contact with or proximate to the target to deliver electrical current through the target. During local delivery, electrical current may be delivered between activation terminals 235 via the target instead of being discharged via an electrical arc between the activation terminals 235. Activation terminal 235 (or electrode 105)

that is proximate to target tissue may use ionization (e.g., electrical discharge) to establish an electrical coupling with target tissue. Ionization may also be referred to as arcing or electrical arcing.

Ionization occurs when the electric potential (e.g., field strength, potential gradient) across a gap is sufficiently high to ionize (e.g., break down) the gas (e.g., air) molecules in the gap. The ionized molecules may establish a low impedance path (e.g., ionization path) across the gap that permits a current to flow across the gap. The air between activation terminals 235 that are spaced apart on a face (e.g., front) of a CEW may be ionized to permit a current to flow between each activation terminal 235 (e.g., forming the electrical arc). The air between electrode 105 and target tissue may be ionized to permit a current to flow between electrode 105 and the target. As discussed above, ionization may be used to establish an electrical coupling, for example between one or more activation terminals 235 and target tissue and/or between one or more electrodes 105 and target tissue.

Ionization of air produces an audible sound as a result of the rapid expansion of the air. The sound produced by ionization of air in gaps is referred to herein as the sound of ionization. Ionizing the air establishes a low impedance ionization path from activation terminals 235 or electrodes 105 to target tissue that may be used to deliver a current into target tissue via the ionization path. After ionization, the ionization path will persist (e.g., remain in existence) as long as a current is provided via the ionization path. When the current provided by the ionization path ceases or is reduced below a threshold (e.g., amperage, voltage), the ionization path collapses (e.g., ceases to exist) and activation terminals 235 or electrodes 105 are no longer electrically coupled to target tissue because the impedance between activation terminals 235 or electrodes 105 and target tissue is high.

In various embodiments, the electrical arc discharge between activation terminals 235 may also operate to provide a warning to a target. A warning may inhibit locomotion of a target by convincing the target to stop moving to avoid possible delivery of the current. A warning may convince a target to flee to avoid possible delivery of the current. The electrical arc may be visible to the naked eye. Activation terminals 235 may discharge the electrical arc as a series of pulses. The series of pulses includes two or more spaced apart pulses of electrical current. Each pulse includes a high voltage portion for ionization of air in a gap. Each time a pulse of the current establishes the electrical arc, an audible sound (e.g., noise) is produced. Thus, the electrical arc provided by activation terminals 235 may be both visible and audible. The electrical arc between each activation terminal 235-1, 235-2 and any sound (e.g., noise) that results due to arcing operates to warn a target of the presence of a CEW and its use.

As discussed further herein, controller 220 may be configured to control transmission of the electrical current from HV module 227 to each activation terminal 235. For example, controller 220 may enable flow of the electrical current in response to warning trigger 230 being activated.

In various embodiments, the warning (e.g., the electrical arc) may be activated using one or more suitable methods. For example, housing 210 may comprise a warning button on grip end 213. The warning button may be electronically coupled to controller 220, and in response to a user activating the warning button, controller 220 may enable electrical current to flow from HV module 227 to each activation terminal 235. As a further example, the warning may be activated by a warning voice command. Housing 210 may comprise a microphone or similar listening device electronically coupled to controller 220. In response to a user audibly issuing the warning voice command, controller 220 may enable electrical current to flow from HV module 227 to each activation terminal 235. As a further example, the warning may be activated by movement by the user, such as in response to the user tapping CEW 100 against an object, making a punching motion, moving the CEW 100 at a speed greater than a defined warning speed, and/or the like. Housing 210 may comprise an accelerometer, gyroscope, and/or the like electronically coupled to controller 220. Controller 220 may comprise logic configured to receive data from the accelerometer, gyroscope, etc., and may enable electrical current to flow from HV module 227 to each activation terminal 235 in response to detecting a warning activation was made by the user.

In various embodiments, the warning may be activated using warning trigger 230. Warning trigger 230 may be coupled to outer surface 211 proximate grip end 213. For example, warning trigger 230 may be coupled to outer surface 211 proximate handle opening 217, and/or at any other suitable location. Warning trigger 230 may be mechanically, electronically, or electromechanically coupled to controller 220. Warning trigger 230 may comprise a mechanical or electromechanical switch, button, or the like. For example, warning trigger 230 may comprise a switch, a pushbutton, and/or any other suitable type of trigger. In response to warning trigger 230 being activated (e.g., depressed, pushed, etc. by the user), controller 220 may enable flow of the electrical current from HV module 227 to one or more activation terminals 235 (e.g., controller 220 may enable electrical coupling between the components in response to receiving a warning input).

In various embodiments, warning trigger 230 may also function as a safety. In that regard, CEW 100 may be unable to launch electrodes 105 and/or provide an electrical current via electrodes 105 and/or activation terminals 235 until warning trigger 230 is activated. In response to warning trigger 230 being activated (e.g., a user depressing warning trigger 230), CEW 100 may be able to launch electrodes 105 and/or provide an electrical current via electrodes 105 and/or activation terminals 235.

In various embodiments, CEW 100 may be activated to launch electrodes using one or more suitable methods. For example, housing 210 may comprise an activation button on the grip end 213. The activation button may be electronically coupled to controller 220, and in response to a user activating the activation button controller 220 may launch the electrodes. As a further example, CEW 100 may be activated by a voice command. Housing 210 may comprise a microphone or similar listening device electronically coupled to controller 220. In response to a user audibly issuing the voice command, controller 220 may activate to launch the electrodes. As a further example, CEW 100 may be activated in response to movement by the user, such as in response to a user making a punching motion. Housing 210 may comprise an accelerometer, gyroscope, and/or the like electronically coupled to controller 220. Controller 220 may comprise logic configured to receive data from the accelerometer, gyroscope, etc., and activate to launch the electrodes in response to determining a movement activation was made by the user.

In various embodiments, activation terminals 235 may also be configured to control deployment (e.g., launching, firing, etc.) of one or more electrodes 105. For example, each activation terminal 235-1, 235-2 may comprise a mechanical or electromechanical switch, button, or the like. In response to one or more activation terminals 235 being at least partially depressed, controller 220 may be configured to enable (or activate) the electrodes 105 to be launched, as discussed further herein. In operation at short ranges, the activation terminals 235 may be pressed against a target to cause deployment of the electrodes 105. In embodiments, actuation of at least one activation terminal among a plurality of activation terminals 235 may cause deployment of the electrodes 105; in other embodiments, both or all activation terminals 235 must be depressed before electrodes 105 are deployed.

In various embodiments, components of CEW 100 may be symmetrically configured. The components may be symmetrically configured in addition to or independent of a symmetrical or non-symmetrical shape of an outer surface 211 of a CEW 100. For example, warning trigger 230 may have a symmetrical shape, may be symmetrically located on outer surface 211, and/or may be symmetrically positioned within opening 217. Opening 217 itself may have a symmetrical shape. Activation buttons, such as activation terminals 235, may also be positioned at symmetrical locations on outer surface 211. One or more trigger safeties, guards, and other components may also be placed in a symmetrical manner on CEW 100. Multiple components of a same type, such as multiple activation buttons or trigger safeties, may be disposed at symmetrical relative locations on CEW 100. Such symmetry may enable CEW 100 to be held (e.g., grasped, handled, gripped, etc.) in different operating positions, yet still be used (e.g., activated, actuated, depressed, positioned relative to a target, etc.) in a same manner. For example, CEW 100 may be reversible between different hands of a user, as well as reversible between different orientations within a same hand of a user. A warning trigger, activation button, or other component may be provided at a same location relative to one or more thumbs or fingers of a user, regardless of an operating position in which the CEW 100 is held in a hand of the user. By providing multiple different operating positions in which a user may hold and then activate a CEW, a time necessary for a user to deploy a CEW may be decreased or otherwise minimized, thereby improving the utility and situational effectiveness of the CEW.

Figure 3:
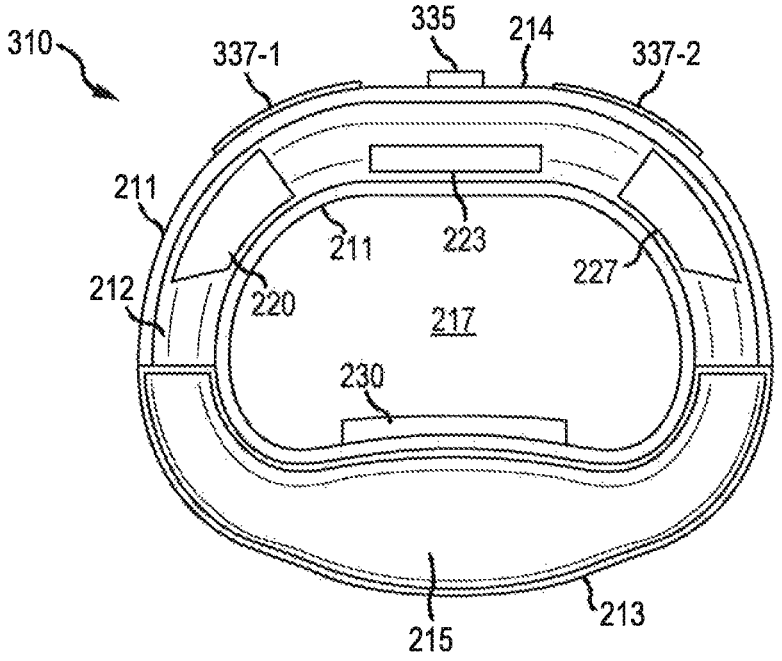
FIG. 3 illustrates a cross-sectional view of a CEW housing comprising one activation terminal, in accordance with various embodiments.

Housing 210 may comprise any suitable configuration of activation terminals, activation buttons, electrical terminals, and/or the like. In various embodiments, and with reference to FIG. 3, a housing 310 may comprise a single activation terminal 335. Housing 310 may be similar to housing 210, with brief reference to FIGS. 2A-2C. Activation terminal 335 may be similar to activation terminals 235-1, 235-2, with brief reference to FIGS. 2A-2C. In response to warning trigger 230 being activated, activation terminal 335 may deliver an electrical arc proximate target end 214. For example, activation terminal 335 may deliver the electrical arc from each side of activation terminal 335 proximate target end 214. Outer surface 211 of housing 310 may comprise a conductive surface 337 configured to distribute the electrical arc along each side of outer surface 211 proximate activation terminal 335. Activation terminal 335 may be configured to discharge the electrical arc along the housing 210 to a conductive surface 337. For example, outer surface 211 may comprise a first conductive surface 337-1 and/or a second conductive surface 337-2. Each conductive surface 337 may comprise any suitable conductive materials and may comprise a surface coating, a conductive pad, or the like.

In various embodiments, activation terminal 335 (or activation terminals 235 or electrical terminals 439) may deliver the electrical arc across all or a substantial portion of target end 214. For example, activation terminal 335 may deliver the electrical arc from activation terminal 335, across target end 214, and to a location proximate each electrode blast door 155. Conductive surfaces 337 may be coupled to outer surface 211 on target end 214, and extend from activation terminal 335 to each electrode blast door 155 to aid in distributing the electrical arc and/or the local delivery of electrical current through a target. Conductive surfaces 337 may be further coupled to one or more of a power supply 223 and a HV module 227 to complete an electrical path for electrical current provided through an electrical arc and/or target tissue.

Figure 4:
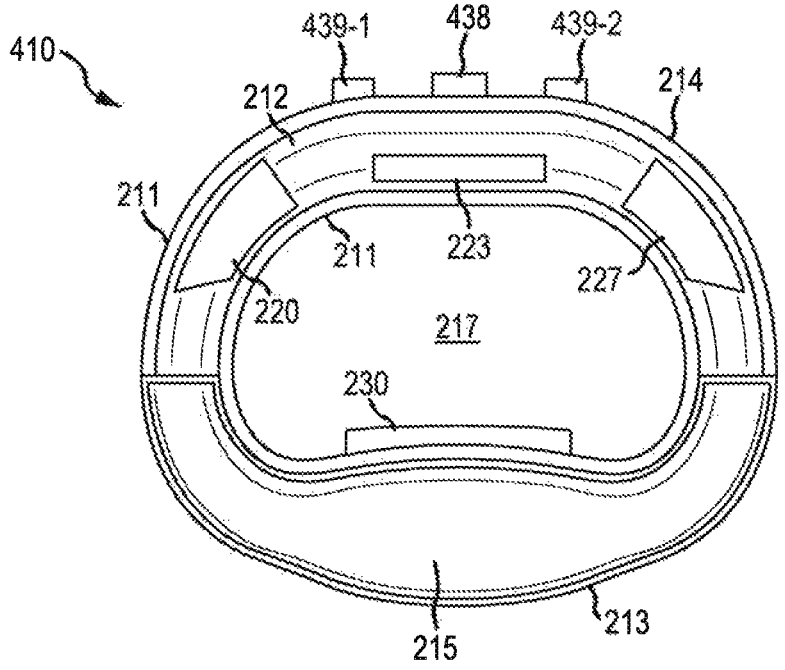
FIG. 4 illustrates a cross-sectional view of a CEW housing comprising a separate activation button and electrical terminals, in accordance with various embodiments.

In various embodiments, and with reference to FIG. 4, a housing 410 may comprise separate electrical terminals and activation buttons. For example, housing 410 may comprise a first electrical terminal 439-1, a second electrical terminal 439-2, and/or an activation button 438. First electrical terminal 439-1, second electrical terminal 439-2, and activation button 438 may be coupled to target end 214. Activation button 438 may be disposed between each electrical terminal 439, and/or at any other suitable location on target end 214.

Each electrical terminal 439 may be configured to discharge an electrical arc (e.g., similar to activation terminals 235, with brief reference to FIGS. 2A-2C). For example, in response to warning trigger 230 being activated (e.g., depressed, pushed, etc. by the user), controller 220 may enable flow of the electrical current from HV module 227 to one or more electrical terminals 439 (e.g., controller 220 may enable electrical coupling between the components in response to receive a warning input). In response to receiving the electrical current, electrical terminal 439 may discharge the electrical arc.

Activation button 438 may be configured to control deployment (e.g., launching, firing, etc.) of one or more electrodes 105 (e.g., similar to activation terminals 235, with brief reference to FIGS. 2A-2C). Activation button 438 may comprise a mechanical or electromechanical switch, button, or the like. In response to activation button 438 being at least partially depressed, controller 220 may be configured to enable (or activate) the electrodes 105 to be launched, as discussed further herein. In operation at short ranges, activation button 438 may be pressed against a target to cause deployment of the electrodes 105.

In various embodiments, and with reference again to FIGS. 2A-2C, controller 220 may include circuitry, electrical components, and/or electronic components capable of performing functions and operations in CEW 100. Controller 220 may be in electronic communication (e.g., electronically coupled) with activation terminals 235, warning trigger 230, and/or cartridge 150 (e.g., in response to cartridge 150 being coupled to housing 210). Controller 220 may be in electrical communication (e.g., electrically coupled) with power supply 223. Controller 220 may be configured to establish or break one or more electrical circuits in response to receiving an input. For example, in response to receiving a warning input from warning trigger 230 (e.g., in response to warning trigger 230 being activated, depressed, etc.), controller 220 may electrically control a warning switch 221 to enable electrical current to pass from HV module 227 to each activation terminal 235 (e.g., activation terminal 235-1, 235-2). For example, in response to receiving an activation input from activation terminals 235 (e.g., in response to activation terminal 235-1 and/or activation terminal 235-2 being activated), controller 220 may electrically control an activation switch 229 to enable electrical current to pass from HV module 227 to cartridge 150.

Controller 220 may comprise a processing circuit, a processor, digital signal processor, a microcontroller, a microprocessor, an application specific integrated circuit, a programmable logic device, logic circuitry, state machines, MEMS devices, signal conditioning circuitry, communication circuitry, a computer, a computer-based system, a radio, a network appliance, data busses, address busses, and/or any combination thereof.

In various embodiments, controller 220 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, controller 220 may include data buses, output ports, input ports, timers, memory, arithmetic units, and/or the like.

In various embodiments, controller 220 may include a sensor attached to warning trigger 230 configured to generate a warning input each instance warning trigger 230 is activated. The sensor may comprise any suitable mechanical, electronic, and/or electromechanical sensor capable of sensing an activation or depression in warning trigger 230, and reporting the activation or depression to controller 220.

Power supply 223 may be configured to provide electrical power to various components in CEW 100. Power supply 223 may provide energy for operating the electronic and/or electrical components (e.g., parts, subsystems, circuits) of CEW 100 and/or one or more electrodes 105. For example, power supply 223 may be in electrical communication (e.g., electrically coupled) with controller 220 and/or HV module 227. Power supply 223 may provide an electrical current at a voltage. Electrical power from power supply 223 may be provided as a direct current ("DC"). Electrical power from power supply 223 may be provided as an alternating current ("AC"). Power supply 223 may include a battery. For example, power supply 223 may comprise a nine-volt battery. The energy of power supply 223 may be renewable or exhaustible, and/or replaceable. For example, power supply 223 may comprise one or more rechargeable or disposable batteries.

Power supply 223 may provide energy for performing the functions of CEW 100. Power supply 223 may provide the electrical current to HV module 227 that is provided through a target to impede locomotion of the target. For example, the electrical current provided to the target may be delivered via activation terminals 235 (e.g., from power supply 223 to HV module 227 to one or more activation terminals 235). The electrical current may also be delivered to the target via electrodes 105 (e.g., from power supply 223 to HV module 227 to electrode filament 107 to electrode 105).

High-voltage (HV) module 227 may be configured to provide an electrical current to various components in CEW 100. HV module 227 may include circuits for receiving electrical energy and for providing the electrical current. The electrical and/or electronic circuits of HV module 227 may comprise one or more capacitors, resistors, inductors, spark gaps, transformers, silicon controlled rectifiers ("SCRs"), analog-to-digital converters, and/or the like. HV module 227 may receive electrical energy from power supply 223. HV module 227 may convert the electrical energy into the electrical current for interfering with locomotion of a target. HV module 227 may discharge the electrical current to one or more activation terminals 235 and/or cartridge 150. In various embodiments, HV module 227 may discharge separate electrical currents to each of the activation terminals 235 and cartridge 150 (e.g., a first electrical current to activation terminals 235 and a second electrical current to cartridge 150). In various embodiments, HV module 227 may also discharge the same electrical current to activation terminals 235 and cartridge 150. The electrical current may be controlled by controller 220. For example, controller 220 may control HV module 227 to discharge the electrical current. Controller 220 may also control one or more electrical switches configured to control the flow of the electrical current (e.g., warning switch 221, activation switch 229, etc.).

The electrical current may be provided as a pulse of electrical current. The electrical current may be provided as a series of pulses. HV module 227 may provide the electrical current at a voltage sufficient in magnitude to inhibit or interfere with locomotion in the target. HV module 227 may provide the electrical current at a voltage sufficient in magnitude to ionize air in one or more gaps in series with HV module 227 and the target (e.g., via electrodes 105) to establish one or more ionization paths to sustain delivery of the electrical current through target tissue to interfere or inhibit locomotion of the target. HV module 227 may provide the electrical current at a voltage sufficient in magnitude to impede locomotion of a target by inducing fear, pain, and/or an inability to voluntary control skeletal muscles, as previously discussed above.

Figure 5:
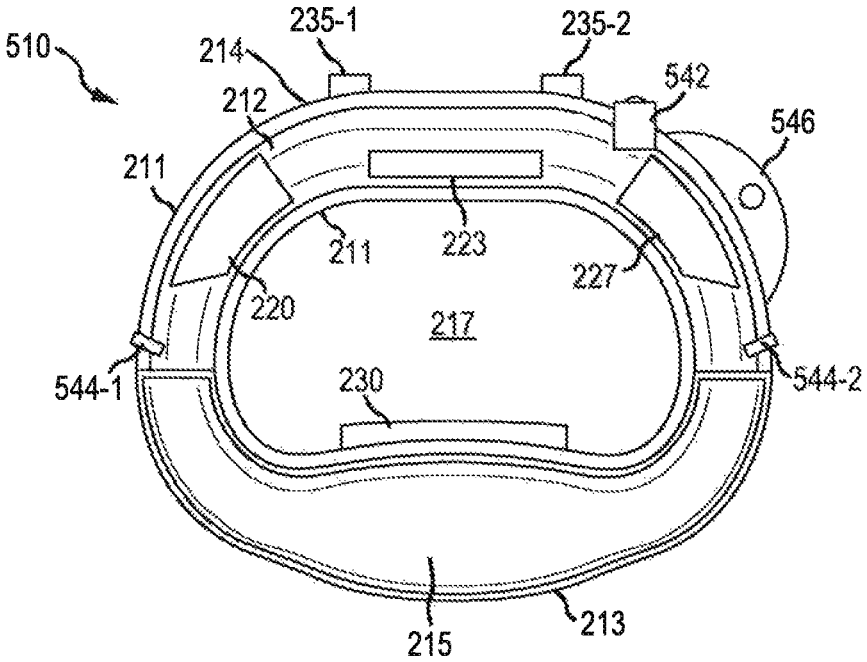
FIG. 5 illustrates a cross-sectional view of a CEW housing comprising accessory components, in accordance with various embodiments.

In various embodiments, housing 210 may comprise one or more accessory components. For example, and with reference to FIG. 5, a housing 510 may comprise a flashlight 542, one or more laser sights 544, an attachment point 546, and/or any other suitable or desired accessory or add-on component.

Flashlight 542 may comprise any suitable type of flashlight, light-producing component, or the like capable of producing light (e.g., a lightbulb, LED, etc.). Flashlight 542 may be electrically coupled to power supply 223. Flashlight 542 may comprise an activation switch configured to activate flashlight 542 to produce light. In various embodiments, flashlight 542 may be activated by warning trigger 230. For example, in response to warning trigger 230 being activated (e.g., depressed), flashlight 542 may activate simultaneously (or in near time) with activation terminals 235-1, 235-2 such that flashlight 542 may produce light together with activation terminals 235-1, 235-2 discharging the electrical arc. In other embodiments, an activation switch for flashlight 542 may be provided in addition to warning trigger 230, enabling the flashlight 542 to be alternately or additionally activated separately from the warning trigger 227 230.

Housing 510 may comprise one or more laser sights 544 configured to aid in accurately aligning deployment of the electrodes 105 to the target. For example, housing 510 may comprise a first laser sight 544-1 and a second laser sight 544-2. First laser sight 544-1 may be disposed through outer surface 211 proximate cartridge bay 215. For example, first laser sight 544-1 may be disposed proximate the location of a first electrode blast door in response to cartridge 150 being coupled within cartridge bay 215. Second laser sight 544-2 may be disposed through outer surface 211 proximate cartridge bay 215. For example, second laser sight 544-2 may be disposed proximate the location of a second electrode blast door in response to cartridge 150 being coupled within cartridge bay 215. Each laser sight 544 may be disposed at an angle similar to the deployment angle of each electrode 105 in cartridge 150 (e.g., along first deployment axis 601-1 and second deployment axis 601-2, with brief reference to FIG. 6A). Each laser sight 544 may be configured to activate to produce an aiming laser in response to warning trigger 230 being activated (e.g., depressed). Each laser sight 544 may comprise any suitable laser-output component.

Attachment point 546 may be configured to enable housing 510 to be removably coupled to an object. For example, attachment point 546 may be coupled to outer surface 211. Attachment point 546 may enable housing 510 to couple to a dog leash, a purse, a backpack, and/or any other suitable or desired object. For example, attachment point 546 may comprise a void configured to receive a clip or similar attachment mechanism. The clip or similar attachment mechanism may then be coupled to the object. In various embodiments, attachment point 546 may be releasably coupled to the object. For example, attachment point 546 may be configured to release (e.g., decouple from the object) in response to a user pulling or disengaging housing 510 from the object.

Figure 6A:
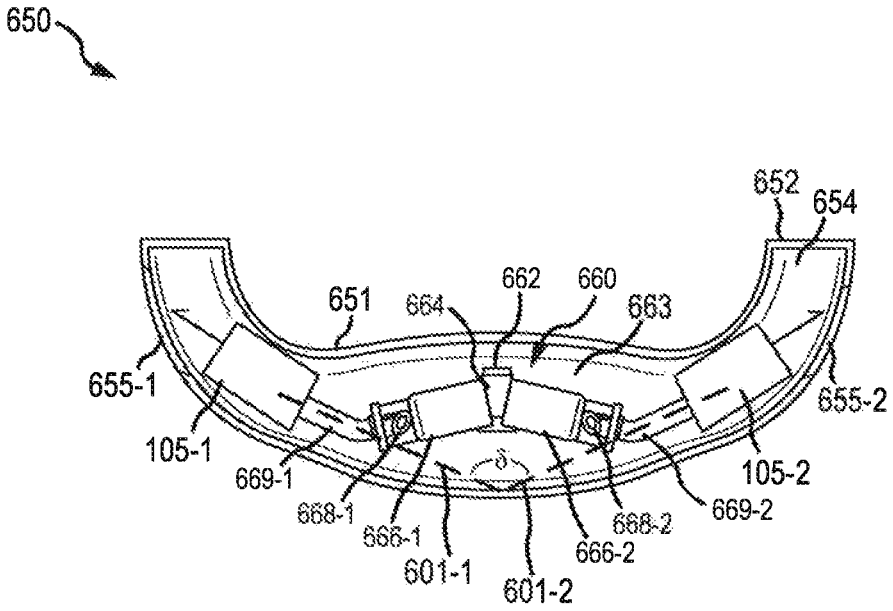
FIG. 6A illustrates a cross-sectional view of a CEW cartridge, in accordance with various embodiments.
Figure 6B:
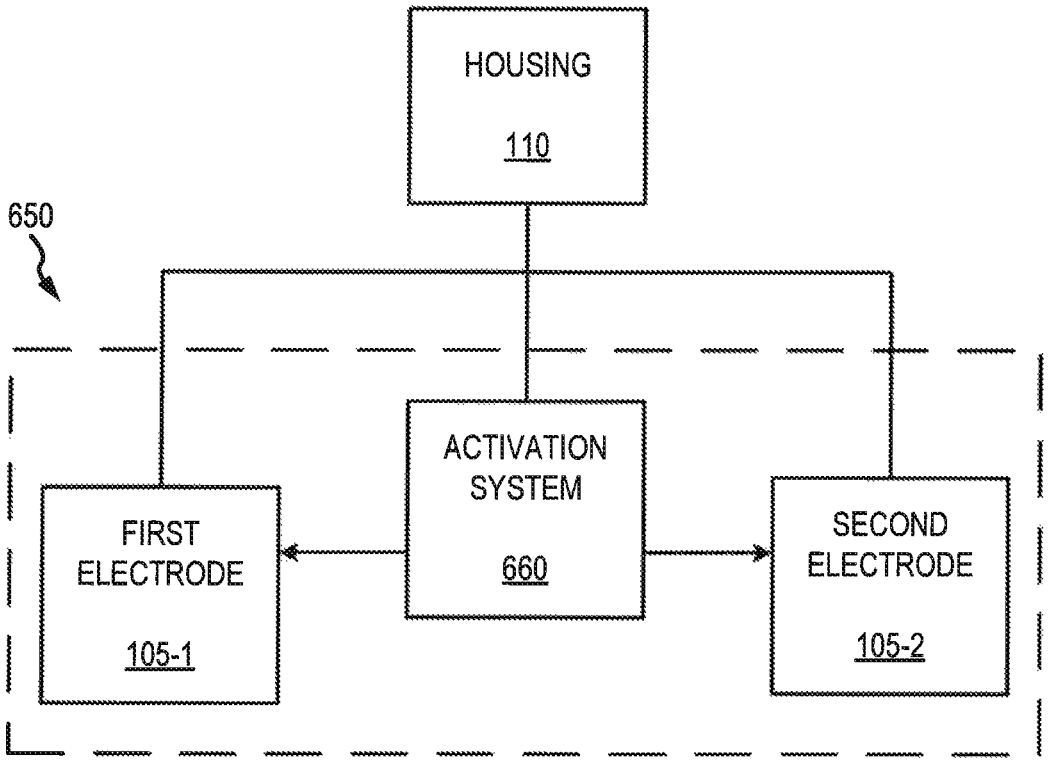
FIG. 6B illustrates a functional view of a CEW cartridge, in accordance with various embodiments.

In various embodiments, and with reference to FIGS. 6A and 6B an exemplary cartridge 650 is depicted. Cartridge 650 may comprise an engagement end 651 configured to be inserted within cartridge bay 115 of housing 110 to couple cartridge 650 to housing 110. Cartridge 650 may comprise an outer surface 652 (e.g., a cartridge outer surface) opposite an inner surface 654 (e.g., a cartridge inner surface). Inner surface 654 may be configured to house various components of cartridge 650, including electrodes 105 (e.g., first electrode 105-1 and second electrode 105-2). Each electrode 105 may be in electrical communication (e.g., electrically coupled) with housing 210. For example, and with brief reference to FIGS. 2A-2C, each electrode 105 may be in electrical series with HV module 227, via electrode filaments 107, as previously discussed. The electrode filaments 107 may be configured to deliver the electrical current to each electrode 105 in response to CEW 100 being activated (e.g., in response to activation terminals 235 being at least partially depressed). The electrode filaments 107 may also be configured to mechanically couple each electrode 105 directly or indirectly to inner surface 654.

Each electrode 105 may be disposed on inner surface 654 within cartridge 650 along a deployment axis 601. For example, first electrode 105-1 may be disposed along a first deployment axis 601-1. Second electrode 105-2 may be disposed along a second deployment axis 601-2. First deployment axis 601-1 and second deployment axis 601-2 may define a deployment angle delta ("δ"). Each electrode may be configured to be deployed from CEW 100 along deployment axis 601. Each electrode 105 may travel along a respective deployment axis 601 upon being launched from housing 210. One or more of electrode attachment 106 and electrode filament 107 may be physically coupled to each respective electrode 105 along the respective deployment axis 601 of the electrode 105. An electrode attachment 106 of each electrode 105 may be oriented along a deployment axis 601. An electrode attachment 106 of an electrode 105 may be disposed on a side of the electrode 105 oriented along a deployment axis 601. A deployment axis 601 may define a trajectory for an electrode 105 along which the electrode 105 may attach to a target. In embodiments, one or more of a propellant chamber 669, activation pin 668, and propellant capsule 666 associated with an electrode 105 may also be disposed along a deployment axis 601 with an electrode 105. In other embodiments, at least one of a propellant chamber 669, activation pin 668, and propellant capsule 666 may be disposed along a deployment axis 601 associated with an electrode 105, while a subset of these components may be disposed off-axis from the deployment axis 601. For example, a propellant chamber 669 and activation pin 668 may be disposed on a deployment axis 601 of an electrode 105, while a propellant capsule 666 may be disposed off-axis from the deployment axis 601 of the electrode 105. In embodiments, other components of a CEW 100 or cartridge 650 may also be disposed off-axis from a deployment axis 601 of an electrode 105, including one or more of an engagement end 651, a primer 662, an activation wedge 664, a warning trigger 230, and/or one or more activation terminals 235 of a CEW 100.

Deployment angle δ may define an angle from which each electrode 105 is displaced relative to each other (e.g., first electrode 105-1 relative to second electrode 105-2, or second electrode 105-2 relative to first electrode 105-1). Deployment angle δ may comprise any suitable or desired angle, and may be based on the short-range deployment of CEW 100.

For example, deployment angle δ may define a launch angle suitable to ensure that a minimum spacing between the electrodes 105 is maintained when coupled to the target (e.g., post-launch). Deployment angle δ may comprise an angle greater than the deployment angle of typical CEWs. For example, deployment angle δ may comprise an angle greater than about 15°. Deployment angle δ may be an obtuse angle, that is, an angle greater than 90° and less than 180°. For example, deployment angle δ may comprise an angle of about 90° to about 120°, about 120° to about 150°, or about 150° to about 180° (wherein about as used in any of the above contexts refers only to +/−5°).

In embodiments, the minimum spacing may be associated with a minimum distance or range at which electrodes 105 may attach to a target. The minimum distance or range may be determined in a direction from a grip end 213 to a target end 214 of a CEW 100. For example, a minimum spacing may be defined at a location of an outer surface 211 of a target end 214 of a CEW 100. Upon traveling beyond a target end 214 of a CEW 100, electrodes 105 may be separated by a minimum spacing in accordance with a deployment angle δ at which each electrode 105 is deployed. Electrodes 105 may be separated by at least a minimum spacing when an electrode attachment 106 of each electrode 105 crosses a plane along a target end 214 of a CEW 100 in which an activation terminal 235 may be disposed on the CEW 100. Accordingly, electrodes 105 may be positioned with a minimum spacing on a same target that may have caused the electrodes 105 to be deployed from the CEW 100.

Each electrode 105 may include a respective deployment axis 601, including multiple electrodes 105 in multiple cartridges 150. For example, a first cartridge 150-1 may include a first electrode 105-1 disposed along a first deployment axis 601-1 and a second electrode 105-2 disposed along a second deployment axis 601-2, while a second cartridge 150-2 may include a third electrode 105-3 disposed along a third deployment axis and a fourth electrode 105-4 disposed along a fourth deployment axis. The first deployment axis 601-1 and the second deployment axis 601-2 may define a first deployment angle, while the third deployment axis and the fourth deployment axis may define a second deployment angle. Each deployment angle associated with each of multiple cartridges 150 may be an obtuse angle, including the first deployment angle associated with a first cartridge 150-1 and a second deployment angle associated with a second cartridge 150-2. In various embodiments, the first deployment angle and the second deployment angle may be a same angle.

In various embodiments, cartridge 650 may comprise one or more electrode blast doors 655 configured to align with a deployment axis 601 of the relative electrode 105. For example, cartridge 650 may comprise a first electrode blast door 655-1 and a second electrode blast door 655-2. First electrode blast door 655-1 may define a void through outer surface 652 aligned with first deployment axis 601-1. First electrode blast door 655-1 may be sized and shaped to enable first electrode 105-1 to pass through outer surface 652 in response to being launched. Second electrode blast door 655-2 may define a void through outer surface 652 aligned with second deployment axis 601-2. Second electrode blast door 655-2 may be sized and shaped to enable second electrode 105-2 to pass through outer surface 652 in response to being launched. Each electrode blast door 655 may be filled with a blast panel to at least partially cover the electrode blast door 655, and the electrode 105 disposed within. For example, the blast panels may comprise a rubber or plastic object configured to at least partially fill the void defined by each electrode blast door 655. In response to an electrode 105 being deployed, the electrode 105 may exert force on the blast panel to cause the blast panel to decouple from the electrode blast door 655, thus enabling the electrode 105 to be launched through outer surface 652.

In various embodiments, cartridge 650 may comprise various components configured to aid in deployment of electrodes 105. For example, cartridge 650 may comprise an activation system 660 disposed in an activation chamber 663 between each electrode 105. Activation chamber 663, activation system 660, and electrodes 105 may be enclosed by an outer surface 652 of cartridge 650. Activation system 660 may be coupled to inner surface 654 of cartridge 650. Activation system 660 may be configured to launch electrodes 105. Activation system 660 be in electrical communication (e.g., electrically coupled) with housing 110. For example, and with brief reference to FIGS. 2A-2C, activation system 660 may be in electrical series with HV module 227. In response to CEW 100 being activated (e.g., in response to activation terminals 235 being at least partially depressed), controller 220 may enable electrical current to pass from HV module 227 to activation system 660. In response to receiving the electrical current, activation system 660 may launch electrodes 105.

In various embodiments, activation system 660 may comprise a primer 662, an activation wedge 664, one or more propellant capsules 666, one or more activation pins 668, and/or one or more propellant chambers 669. Activation system 660 may be configured to launch a plurality of electrodes 105 using a single primer 662.

Primer 662 may comprise a cap, cylinder, or the like containing a charge or explosive. Primer 662 may comprise a compound that responds to friction or an electrical impulse to ignite the charge or explosive. For example, primer 662 may be in electrical communication (e.g., electrically coupled) with housing 110. In response to receiving an electrical charge, primer 662 may activate (e.g., ignite the charge or explosive) to apply a force on an end of activation wedge 664 to push activation wedge 664 in a direction opposite primer 662.

Activation wedge 664 may comprise a wedge shape, a triangular shape, or the like. Activation wedge 664 may be proximate primer 662 on a first end. Activation wedge 664 may be proximate one or more propellant capsules 666. For example, activation wedge 664 may be proximate a first propellant capsule 666-1 on a first surface of activation wedge 664. Activation wedge 664 may be proximate a second propellant capsule 666-2 on a second surface of activation wedge 664. In response to primer 662 being activated and imparting force on activation wedge 664, activation wedge 664 may impart force against each propellant capsule 666 to push each propellant capsule 666 in a direction away from each other. For example, activation wedge 664 may push first propellant capsule 666-1 in a first direction away from the second propellant capsule 666-2, and the second propellant capsule 666-2 in a second direction away from the first propellant capsule 666-1. In embodiments, a same activation wedge 664 may impart force upon first propellant capsule 666-1 and second propellant capsule 666-2 at a same time (or near same time).

Each propellant capsule 666 may be configured to retain a pressurized propellant (e.g., air, gas, etc.). Each propellant capsule 666 may comprise a material capable of being punctured by activation pin 668 such as, for example, a plastic, a thin metal, or the like. In response to activation wedge 664 imparting a force against each propellant capsule 666, propellant capsule 666 may move in a direction towards a proximate activation pin 668. For example, activation pin 668 may comprise a sharp or pointed object or end capable of puncturing propellant capsule 666. In response to propellant capsule 666 contacting activation pin 668, activation pin 668 may activate the propellant capsule 666 by puncturing propellant capsule 666 to release the propellant. For example, activation wedge 664 may impart force against first propellant capsule 666-1 to push first propellant capsule 666-1 towards a first activation pin 668-1. In response to first propellant capsule 666-1 contacting first activation pin 668-1, first activation pin 668-1 may puncture first propellant capsule 666-1 to release a first propellant. Activation wedge 664 may impart force against second propellant capsule 666-2 to push second propellant capsule 666-2 towards a second activation pin 668-2. In response to second propellant capsule 666-2 contacting second activation pin 668-2, second activation pin 668-2 may puncture second propellant capsule 666-2 to release a second propellant.

In response to propellant capsule 666 being activated (e.g., punctured) by activation pin 668, propellant capsule 666 may release propellant through the associated propellant chamber 669. Propellant chamber 669 may be in fluid communication with the associated propellant capsule 666 and a proximately disposed electrode 105. For example, a first propellant chamber 669-1 may be in fluid communication with first propellant capsule 666-1 and first electrode 105-1. A second propellant chamber 669-2 may be in fluid communication with second propellant capsule 666-2 and second electrode 105-2. The propellant may propel the proximately disposed electrode 105 towards a target. The propellant applies a force (e.g., from expanding gas) on a surface of the electrode 105 to push the electrode 105 from cartridge 650 toward the target. The force applied to the electrode 105 may be sufficient to accelerate the electrode 105 to a velocity suitable for traversing a distance to a target, for deploying the respective electrode filament 107 coupled to the electrode 105, and for coupling, if possible, the electrode 105 to the target.

Figure 7:
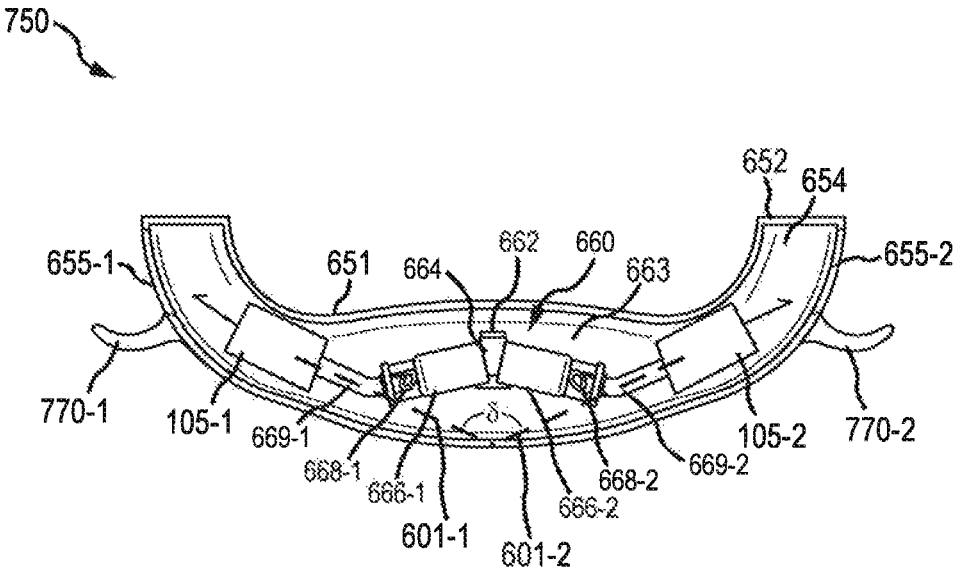
FIG. 7 illustrates a cross-sectional view of a CEW cartridge comprising a safety guard, in accordance with various embodiments.

In various embodiments, and with reference to FIG. 7, a cartridge 750 may comprise one or more safety guards 770. Each safety guard 770 may be configured to at least partially prevent a user from contacting or covering an electrode blast door 655 during operation of CEW 100. Each safety guard 770 may include a rigid, physical projection, configured to prevent human blockage of an electrode blast door 655. Each safety guard may project a distance above outer surface 211. In embodiments, the distance may be at least 0.5 inches and/or less than 1 inch perpendicular to outer surface 211. Cartridge 750 may comprise a first safety guard 770-1 and/or a second safety guard 770-2. First safety guard 770-1 may be coupled to outer surface 211. First safety guard 770-1 may be coupled proximate first electrode blast door 655-1. First safety guard 770-1 may extend from outer surface 211 in a first direction away from outer surface 211.

First safety guard 770-1 may extend from outer surface 211 in a location suitable to at least partially protect a user's hand, fingers, thumb, or the like from contacting or covering first electrode blast door 655-1. Second safety guard 770-2 may be coupled to outer surface 211. Second safety guard 770-2 may be coupled proximate second electrode blast door 655-2. Second safety guard 770-2 may extend from outer surface 211 in a second direction away from outer surface 211. Second safety guard 770-2 may extend from outer surface 211 in a location suitable to at least partially protect the user's hand, fingers, thumb, or the like from contacting or covering second electrode blast door 655-2.

Figure 8:
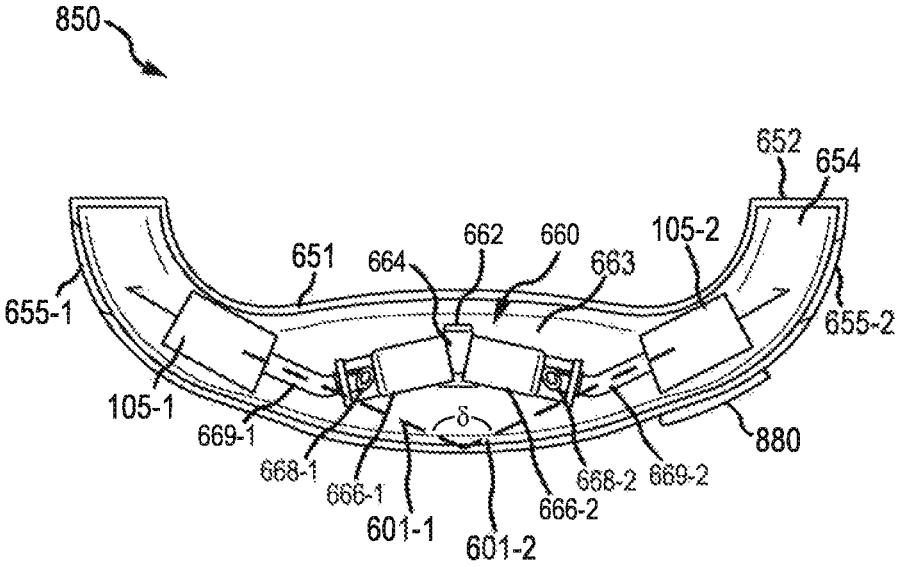
FIG. 8 illustrates a cross-sectional view of a CEW cartridge comprising a safety guard, in accordance with various embodiments.

In various embodiments, and with reference to FIG. 8, a cartridge 850 may comprise a trigger safety 880. Trigger safety 880 may function as a safety mechanism to control cartridge 850 from launching one or more electrodes 105. In that regard, cartridge 850 may be unable to launch electrodes 105 and/or provide an electrical current via electrodes 105 until trigger safety 880 is deactivated. Trigger safety 880 may be in electrical communication with a safety switch or the like configured to control electrical flow to activation system 660 and/or each electrode 105. For example, trigger safety 880 may be in electrical communication with circuitry of at least one of a primer 662, a first electrode 105-1, or a second electrode 105-1. In response to being deactivated, trigger safety 880 may control the safety switch or the like to enable electrical flow to activation system 660 and/or each electrode 105.

In various embodiments, trigger safety 880 may comprise a mechanical or electromechanical switch, button, or the like. For example, trigger safety 880 may comprise a switch, a pushbutton, and/or any other suitable type of trigger. Trigger safety 880 may be deactivated by a user depressing or pushing the mechanical or electromechanical switch, button, or the like. In various embodiments, trigger safety 880 may comprise a safety pin (e.g., similar to a safety pin on a grenade). In that regard, trigger safety 880 may be deactivated by removing the safety pin from cartridge 850.

In various embodiments, trigger safety 880 may comprise a biometric reader. Trigger safety 880 may comprise additional electrical or electronic component to enable functions of the biometric reader, such as, for example, a processing unit, a memory, a biometric sensor to detect biometric samples (e.g., a fingerprint reader), and/or the like. In that regard, trigger safety 880 may be configured to deactivate (e.g., to enable launching of electrodes 105) in response to receiving an authorized biometric input from the user. For example, the biometric reader may store a biometric input, such as a thumbprint, from the user. The biometric reader may encrypt or otherwise digitize the received biometric for storage in memory. In response to receiving a biometric input to deactivate trigger safety 880, the biometric reader may encrypt or otherwise digitize the biometric input and attempt to match the biometric input with the stored biometric input. In response to at least partially matching the biometric input, trigger safety 880 may deactivate to enable launching of electrodes 105. In various embodiments, trigger safety 880 may require the user to maintain pressure on trigger safety 880 before launching electrodes 105. In various embodiments, the biometric input may be one or more of the user's voice, vascular pattern, fingerprint, DNA sample, hand geometry, iris, retinal, face, or any other biometric relating to recognition based upon any body part of the user.

As depicted in FIG. 8, and in accordance with various embodiments, cartridge 850 may comprise a single trigger safety 880. In other embodiments, multiple trigger safeties may be provided. For example, a trigger safety may be positioned proximate each electrode blast door 655, enabling a CEW 100 to be grasped such that either electrode blast door 655 is proximate a user's thumb. Such an arrangement for each trigger safety 880 may also bias a thumb of a user to be placed on one of such trigger safeties 880, rather than inadvertently over an electrode blast door 655, thereby discouraging human blockage of the electrode blast door 655.

In various embodiments, one or more trigger safeties may also be positioned on a housing of a CEW, rather than a cartridge. For example, a housing may include a trigger safety on an outer surface proximate a cartridge bay. A location of the trigger safety may be selected to require a thumb of a user to be positioned on a side of the housing, rather than proximate an electrode blast door of a cartridge. In some embodiments, a housing of a CEW may include two or more such trigger safeties. For example, a housing may include four separate trigger safeties, each positioned at separate locations on sides of the housing. Pairs of trigger safeties may be positioned on opposite sides of a housing proximate each electrode blast door, enabling a left thumb or right thumb of a user to access at least one of the trigger safeties when either of two electrode blast doors of a cartridge are positioned proximate the left thumb or right thumb of the user.

Figure 9:
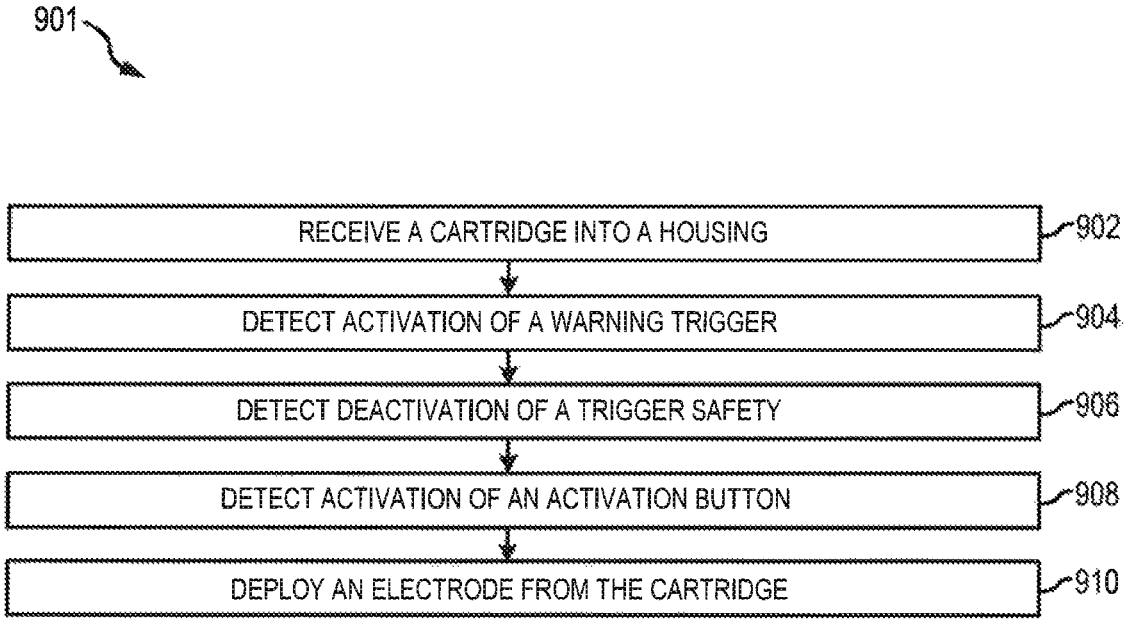
FIG. 9 illustrates a process flow for a method of operation of a CEW, in accordance with various embodiments.

In various embodiments, and with reference to FIG. 9, a method 901 of operation of short-range conducted electrical weapon ("CEW") is disclosed. The CEW may be operable by a user. The user may insert one or more cartridges into a housing. A housing may receive a cartridge (block 902). The housing may comprise a grip end opposite a target end. The grip end of the housing may comprise a cartridge bay sized and shaped to receive at least one cartridge. Inserting the cartridge into the housing may electrically and/or mechanically couple the cartridge with the housing. A cartridge may be electrically and/or mechanically coupled to the housing upon being received by the housing. The user may operate the CEW by holding the grip end. The CEW may comprise a symmetrical circular shape to enable the CEW to be symmetrically operable regardless of how the user holds the grip end.

Activation of a warning trigger may be detected by the CEW (block 904). For example, the user may activate a warning trigger on the grip end of the housing. The user may activate the warning trigger by depressing the warning trigger. A controller located within the housing may be configured to detect activation of the warning trigger. In response to the warning trigger being activated, the controller may enable electrical current to pass from a high-voltage (HV) module to one or more electrical terminals and/or activation terminals. The electrical terminals and/or activation terminals may receive the electrical current and discharge an electrical arc on the activation end of the housing. The controller may also enable electrical power to pass from a battery in the housing to a flashlight, one or more laser sights, or the like deployed from the housing. The controller may also enable electrical communications to allow the CEW to be fired.

Deactivation of a trigger safety may be detected by the CEW (block 906). In various embodiments, the user may deactivate a trigger safety on the housing or the cartridge. The user may deactivate the trigger safety by providing input to the trigger safety (e.g., depressing the trigger safety, flipping a switch, removing a safety pin, providing a biometric input, etc.). In response to being deactivated, the trigger safety may enable electrical current to pass from the HV module in the housing to various components in the cartridge. A controller located within the housing may be configured to detect deactivation of a trigger safety.

Activation of an activation button (e.g., activation button, activation terminal, etc.) may be detected by the CEW (block 908). For example, the user may activate an activation button. The activation button may be activated by being depressed. For example, the user may push the CEW against a target to cause the body of the target to depress the activation button. The controller may be configured to detect activation of the activation button. In response to detecting the activation, the controller may enable electrical current to pass from the HV module to electrical components in the cartridge. For example, the cartridge may comprise an activation system and one or more electrodes. The activation system and one or more electrodes may be in electrical series with the HV module.

In response to the activation button being activated, the CEW may deploy an electrode from the cartridge (block 910). The activation system may receive the electrical current from the HV module. In response to receiving the electrical current, the activation system may activate (e.g., via a primer) to cause propellant to expel the electrode from the cartridge. The electrode may be expelled from the cartridge at a deployment angle δ, and may exit through an electrode blast door on the cartridge. The electrode may be electrically tethered to the cartridge via an electrode filament. The electrode filament may be in electrical series with the HV module to provide the electrical charge through the electrode. The electrode may comprise an electrode attachment configured to attach the electrode to the target.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A conducted electrical weapon comprising:

a housing having a target end and a grip end, wherein the target end is disposed opposite the grip end, and wherein the target end and the grip end define separate portions of the housing; and a cartridge physically disposed within the grip end, wherein the cartridge is fully disposed within the grip end rearward the target end, wherein the cartridge comprises a plurality of electrodes, and wherein the plurality of electrodes are configured to deploy in a forward direction from the grip end towards the target end in response to an activation on the target end of the housing.

2. The conducted electrical weapon of claim 1, wherein prior to the activation a first electrode of the plurality of electrodes is disposed within the grip end along a first deployment axis and a second electrode of the plurality of electrodes is disposed within the grip end along a second deployment axis, wherein the first deployment axis and the second deployment axis define a deployment angle, and wherein the deployment angle is greater than 90° and less than 180°.

3. The conducted electrical weapon of claim 1, further comprising:

a first activation terminal coupled to the target end; and a second activation terminal coupled to the target end, wherein the plurality of electrodes are configured to deploy in response to at least one of the first activation terminal and the second activation terminal being at least partially depressed, and wherein the first activation terminal and the second activation terminal are configured to discharge an electrical arc between each activation terminal in response to the conducted electrical weapon receiving a warning input.

4. The conducted electrical weapon of claim 1, further comprising an activation terminal coupled to an outer surface of the target end, wherein in response to the activation terminal being at least partially depressed, the plurality of electrodes are configured to deploy, and wherein in response to the conducted electrical weapon receiving a warning input the activation terminal is configured to discharge an electrical arc along the outer surface of the target end.

5. The conducted electrical weapon of claim 4, further comprising a conductive surface coupled to the target end proximate the activation terminal, wherein the activation terminal is configured to discharge the electrical arc along the housing to the conductive surface.

6. The conducted electrical weapon of claim 1, further comprising:

a first electrical terminal coupled to an outer surface of the target end;

a second electrical terminal coupled to the outer surface of the target end proximate the first electrical terminal, wherein in response to the conducted electrical weapon receiving a warning input the first electrical terminal and the second electrical terminal are configured to discharge an electrical arc between the first electrical terminal and the second electrical terminal on the outer surface of the target end; and an activation button coupled to the outer surface of the target end between the first electrical terminal and the second electrical terminal, wherein in response to the activation button being at least partially depressed, the plurality of electrodes are configured to deploy.

7. A conducted electrical weapon comprising:

a housing, comprising:

an outer surface opposite an inner surface;

a target end opposite a grip end; and a cartridge bay defining an opening through the outer surface of the grip end; and a cartridge removably coupled within the cartridge bay of the grip end, the cartridge comprising:

a first electrode disposed within the cartridge along a first deployment axis; and a second electrode disposed within the cartridge along a second deployment axis, wherein in response to the conducted electrical weapon being activated the first electrode is configured to deploy in a first direction from the grip end towards the target end of the housing based on the first deployment axis and the second electrode is configured to deploy in a second direction from the grip end towards the target end of the housing based on the second deployment axis, wherein the first deployment axis and the second deployment axis define a deployment angle, and wherein the deployment angle is an obtuse angle.

8. The conducted electrical weapon of claim 7, wherein the housing comprises a symmetrical circular shape.

9. The conducted electrical weapon of claim 7, further comprising:

a battery coupled on the inner surface of the housing;

a controller coupled on the inner surface of the housing, wherein the controller is electrically coupled to the battery; and a high-voltage module coupled on the inner surface of the housing, wherein the high-voltage module is electrically coupled to the battery, wherein the controller is configured to control electrical output from the high-voltage module, and wherein the high-voltage module is electrically coupled to the cartridge.

10. The conducted electrical weapon of claim 9, further comprising an activation terminal coupled to the target end of the housing, wherein the activation terminal is in electronic communication with the controller, and wherein in response to the activation terminal being at least partially depressed the controller is configured to enable an electrical current to pass from the high-voltage module to the cartridge to activate deployment of the first electrode and the second electrode.

11. The conducted electrical weapon of claim 10, further comprising a warning trigger coupled to the outer surface of the housing proximate the cartridge bay, wherein the warning trigger is at least one of mechanically or electronically coupled to the controller, wherein in response to the warning trigger being activated the controller is configured to enable a second electrical current to pass from the high-voltage module to the activation terminal to generate an electrical arc from the activation terminal.

12. The conducted electrical weapon of claim 7, further comprising a second cartridge removably coupled within the cartridge bay of the grip end proximate the cartridge, the second cartridge comprising:

a third electrode disposed within the second cartridge along a third deployment axis; and a fourth electrode disposed within the second cartridge along a fourth deployment axis, wherein in response to a second activation the third electrode and the fourth electrode are configured to deploy in a direction towards the target end of the housing, wherein the third deployment axis and the fourth deployment axis define a second deployment angle, and wherein the second deployment angle is an obtuse angle.

13. A conducted electrical weapon cartridge comprising:

an activation system;

a first electrode disposed along a first deployment axis prior to a deployment, wherein the first electrode is configured to be deployed by the activation system, and wherein the first deployment axis defines a first trajectory of the first electrode from the conducted electrical weapon cartridge towards a target; and a second electrode disposed along a second deployment axis prior to the deployment, wherein the second electrode is configured to be deployed by the activation system, wherein the second deployment axis defines a second trajectory of the second electrode from the conducted electrical weapon cartridge towards the target, wherein the first deployment axis and the second deployment axis define a deployment angle, and wherein the deployment angle is greater than 90° and less than 180°.

14. The conducted electrical weapon cartridge of claim 13, wherein the activation system comprises:

a primer;

an activation wedge configured to be activated by the primer;

a first propellant capsule proximate a first side of the activation wedge; and a second propellant capsule proximate a second side of the activation wedge, wherein in response to the activation wedge being activated the activation wedge is configured to contact the first propellant capsule and the second propellant capsule to cause the first propellant capsule to release a first propellant and the second propellant capsule to release a second propellant.

15. The conducted electrical weapon cartridge of claim 14, wherein the first propellant capsule is proximate the first electrode and the first propellant deploys the first electrode, and wherein the second propellant capsule is proximate the second electrode and the second propellant deploys the second electrode.

16. The conducted electrical weapon cartridge of claim 14, wherein the activation system comprises:

a first activation pin proximate the first propellant capsule opposite the activation wedge, wherein in response to the activation wedge contacting the first propellant capsule the first activation pin punctures the first propellant capsule to release the first propellant; and a second activation pin proximate the second propellant capsule opposite the activation wedge, wherein in response to the activation wedge contacting the second propellant capsule the second activation pin punctures the second propellant capsule to release the second propellant.

17. The conducted electrical weapon cartridge of claim 14, further comprising:

an outer surface enclosing the activation system, the first electrode, and the second electrode;

a first electrode blast door located on the outer surface proximate the first electrode, wherein the first electrode blast door is configured to allow the first electrode to deploy out the outer surface; and a second electrode blast door located on the outer surface proximate the second electrode, wherein the second electrode blast door is configured to allow the second electrode to deploy out the outer surface.

18. The conducted electrical weapon cartridge of claim 17, further comprising:

a first safety guard extending from the outer surface proximate the first electrode blast door; and a second safety guard extending from the outer surface proximate the second electrode blast door, wherein the first safety guard and the second safety guard are configured to at least partially prevent human blockage of the first electrode blast door and the second electrode blast door.

19. The conducted electrical weapon cartridge of claim 14, further comprising a trigger safety in electrical communication with circuitry of at least one of the primer, the first electrode, or the second electrode.

20. The conducted electrical weapon cartridge of claim 19, wherein the trigger safety comprises a biometric reader.

* * * * *